United States Patent [19]

Chou et al.

[11] 4,097,575

[45] Jun. 27, 1978

[54] ROAST-NEUTRALIZATION-LEACH TECHNIQUE FOR THE TREATMENT OF LATERITE ORE

[75] Inventors: Eddie C. J. Chou, Arvada; Craig B. Barlow, Wheatridge; Dale K. Huggins, Arvada, all of Colo.

[73] Assignee: Amax Inc., Greenwich, Conn.

[21] Appl. No.: 739,244

[22] Filed: Nov. 5, 1976

[51] Int. Cl.[2] ..... C01G 53/10

[52] U.S. Cl. ..... 423/150; 75/119

[58] Field of Search ..... 423/150, 140, 155, 554, 423/636; 75/1, 26, 115, 119

[56] References Cited

U.S. PATENT DOCUMENTS

| | | | |
|---|---|---|---|
| 2,384,008 | 9/1945 | Brandenburg | 423/636 |
| 3,466,144 | 9/1969 | Kay | 423/150 |
| 3,991,159 | 11/1976 | Queaneau et al. | 423/150 |

*Primary Examiner*—O. R. Vertiz
*Assistant Examiner*—Brian E. Hearn
*Attorney, Agent, or Firm*—Michael A. Ciomek; Eugene J. Kalil

[57] ABSTRACT

A method is provided for enhancing the neutralization capability of high-magnesium serpentine silicate ore in the neutralization of nickel-containing pregnant leach solution, said solution having a pH of less than about 1 which comprises, providing said high magnesium serpentine ore in particulate form containing by weight over about 5% magnesium, roasting said ore under oxidizing conditions at a temperature below that temperature at which forsterite in said ore recrystallizes, and then adding an amount of said serpentine roasted ore to said pregnant liquor sufficient to raise the pH of the leach solution to a level above 2.

12 Claims, 4 Drawing Figures

ROAST-NEUTRALIZATION-LEACH TECHNIQUE FOR THE TREATMENT OF LATERITE ORE

Figure 1:
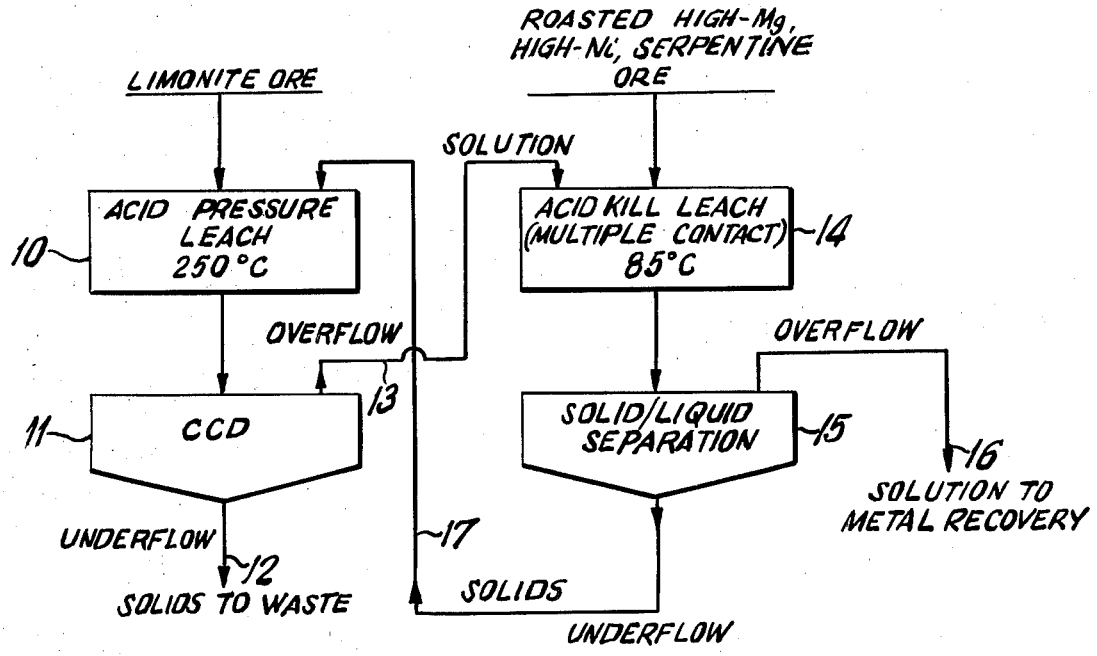

This invention relates to the recovery of nickel from lateritic ores and, in particular, to a method of enhancing the neutralization capability of high-magnesium serpentine ore when employed as a neutralizer in the high pressure, high temperature leaching of nickel lateritic ore.

STATE OF THE PRIOR ART

Methods are known to recover nickel and cobalt from limonitic and serpentine ores. One method, which is referred to as the Moa Bay process, comprises pulping minus 20 mesh nickel ore (95% passing 325 mesh) to approximately 45% solids, and then selectively leaching the nickel and cobalt with sufficient sulfuric acid at elevated temperature and pressure (e.g. 230° to 260° C and 405 to 680 psig) to solubilize about 95% each of the nickel and cobalt in about 60 to 90 minutes. The leached pulp is cooled and then washed by countercurrent decantation, with the washed pulp going to tailings. The acid pH which is quite low (e.g. less than 1) is then neutralized with coral mud to a pH of about 2.4 in a series of four tanks at a total retention time of about 20 minutes and the thus-treated product liquor (containing about 5.95 gpl Ni, 0.8 gpl Fe, and 2.3 gpl Al) is then subjected, after solid-liquid separation, to sulfide precipitation by preheating the leach liquor and carrying out the precipitation with $H_2S$ in an autoclave at about 120° C (250° F) and a pressure of about 150 psig. Usually, nickel sulfide seed is added at the feed end to assure substantially complete precipitation of the nickel and cobalt.

After the sulfide precipitate has been washed and thickened to about 65% solids, it is oxidized in an autoclave at about 177° C (350° F) and a pressure of about 700 psig. The solution of solubilized nickel and cobalt is neutralized with ammonia to a pH (5.35) sufficient to precipitate any residual iron, aluminum and chromium present using air as an oxidant, the precipitate being thereafter separated from the solution. The nickel and cobalt solution is thereafter adjusted in pH to about 1.5 and $H_2S$ added to precipitate selectively any copper, lead and zinc present, which precipitate is separated from the solution by filtration. The nickel is then selectively recovered from the solution by various methods, one particular method comprising treating the solution in an autoclave with hydrogen at a pressure of about 650 psig at a temperature of about 245° C (375° F) using nickel powder as seed material.

A typical Moa Bay-type leach is one in which the ore is leached at 240° - 260° C at an acid ($H_2SO_4$) to ore ratio between 0.22 and 0.26 and a pulp density of about 45%. Many of the refining processes available for the recovery of nickel from the foregoing solution operate most effectively at lower concentrations of acid, iron and aluminum. A typical Moa Bay ore is one containing 1.35% nickel, 0.14% Co, 0.9% Mn, 0.02% Cu, 0.04% Zn, 47% Fe, 10% $Al_2O_3$, 1% MgO and 39.5% of other constituents (e.g. silica) and water of hydration.

The amount of acid employed to leach the nickel ore is generally in substantial excess of the stoichiometric amount necessary because of the pressure of acid-consuming constituents in the ore, such as magnesium, aluminum, iron and the like. Generally, the pH of the pregnant liquor is below 1 (typically 0.5 to 0.7) and, in order to adjust it for the sulfide precipitation of the nickel and cobalt values, an alkaline agent is added, e.g. coral mud, a strong base and the like, which imposes economic disadvantages on the process. The use of a strong base as a neutralizer tends to cause co-precipitation of nickel which should be avoided. For example, in an attempt to use high temperature neutralization of the leach liquor (at 250° C) wherein the liquor is neutralized with MgO to a pH of 1.6, about 35% of the nickel is co-precipitated which is counterproductive such that the full economic advantages of the process are not obtainable.

Processes similar to the foregoing are disclosed in Canadian Pat. No. 922,903 and U.S. Pat. No. 2,798,804 and No. 3,082,080. These and the foregoing Moa Bay process are economical with respect to the leaching of limonitic ore but not in the leaching of high magnesium-containing serpentinic silicate ore.

U.S. Pat. No. 2,111,951; No. 2,151,261, No. 2,872,306 and No. 3,466,144 relate to acid neutralization using coral mud, basic magnesia, lime or lime water or a basic aluminum sulfate. However, the disadvantages of using such neutralizers are as follows:

Coral mud, lime, magnesia, etc., are not necessarily readily available at the site of a laterite ore deposit, so they must be produced or purchased and shipped in. Neutralization with a strong neutralizer, such as magnesia, etc., can form a localized high basic medium and some nickel and cobalt can be precipitated along with the iron and aluminum.

Atmospheric neutralization of the pregnant liquor by the basic aluminum sulfate present in the leached pulp is limited by the amount of basic aluminum sulfate formed in the pressure leach. It also results in an excessively high aluminum concentration in the pregnant liquor going to metal recovery processing, which has to be removed for optimum recovery of metal values.

Selective reduction roasting of the nickel bearing silicate fraction of the laterite ore does not provide good nickel recovery. It requires expensive elaborate controls and excessive fuel is consumed and wasted in the reducing gases.

High temperature neutralization of the free acid in the pulp from acid pressure leaching of laterite, whether magnesia, lime or raw serpentinic material from the laterite ore is used as the neutralizer, cannot go beyond pH 1.2 without precipitating some nickel from the pregnant liquor.

Atmospheric neutralization of pregnant liquor or leached pulp with raw high-nickel serpentinic ore requires unnecessarily long retention times and excessive addition of the ore to reach pH 2.

In Canadian Pat. No. 618,826 (Apr. 28, 1961), a method is proposed for adjusting the pH of a pregnant liquor following primary leaching of a particular ore by employing additional amounts of said ore in the form of a slurry to neutralize excess acid remaining in the pregnant solution. This treatment is carried out at under atmospheric pressure. The patent states that, if ore is employed to neutralize excess acid, it is preferred to add subsequently some lime, limestone or other alkaline agent to adjust the pH of the product or pregnant liquor to the level required (e.g. 3.5 to 4.5) for satisfactory precipitation of aluminum and iron contamination.

In application Ser. No. 539,616 (filed Jan. 9, 1975), now U.S. Pat. No. 3,991,159, a method is disclosed for the high temperature-high pressure neutralization of laterite leach slurry using raw high magnesium-containing serpentine ore.

It would be desirable to use serpentinic ore as a neutralizer in light of its high magnesium content. However, as stated hereinabove, raw serpentine ore requires unnecessarily long retention times and excess addition of the ore to reach a pH of 2. High magnesium serpentinic materials present in nickeliferous laterite ore deposits can be separated into low nickel (<0.5) and high nickel (>1.5%) fractions by screening. It has been found that low nickel serpentine, previously considered as a waste rock, can be converted into an effective neutralizer by roasting it under oxidizing conditions. The high nickel serpentine, previously considered unsuitable for nickel extraction by acid pressure leaching due to its high acid consumption, can similarly be rendered suitable for acid pressure leaching by subjecting it to an oxidizing roast for use as a neutralizer.

OBJECT OF THE INVENTION

It is thus an object of the invention to provide a hydrometallurgical method for recovering nickel and cobalt from low magnesium oxidic ores by using high-magnesium serpentine ore as a neutralizer, the serpentine ore being thermally pretreated to provide enhanced neutralization capability.

Other objects of the invention will more clearly appear when taken in conjunction with the following disclosure and the appended drawings, wherein:

FIGS. 1 to 4 are flow sheets illustrating various embodiments for carrying out the invention.

SUMMARY OF THE INVENTION

As stated herein, nickeliferous laterite ores generally preferred for leaching are those containing high nickel and low magnesium. A particular ore assay is one containing 1.72% Ni, 0.14% Co, 41% Fe, 2.5% Al, 1.58% Mg, 0.8% Mn, 2.05% Cr, 12.1% $SiO_2$ and 11.3% LOI (Loss on Ignition), the elemental metals being combined with oxygen.

As stated earlier, serpentine silicate ore high in magnesium present in nickeliferous laterite deposits can be separated into low nickel (e.g., less than 0.5% Ni) and high nickel (e.g. greater than 1.5%) fractions by screening. We have found that the low-nickel, high-magnesium serpentine, previously considered as waste rock, can be converted into an effective neutralizer by roasting. The high-magnesium, high-nickel serpentine previously considered not too suitable for nickel extraction by acid pressure leaching due to its high acid consumption (high magnesium) can be rendered suitable as a neutralizer and for the recovery of nickel by subjecting the ore to an oxidizing roast.

The oxidizing roast, for either low or high-nickel serpentine, should be carried out at a temperature below that temperature (e.g. below about 820° C) at which recrystallization of forsterite occurs (i.e. magnesium silicate). When forsterite recrystallizes, it is very inert in dilute acid solutions.

Thus, one embodiment of the invention resides in a method of enhancing the neutralization capability of high magnesium serpentine silicate ore in the neutralization of pregnant leach liquor containing nickel and having a pH less than about 1 which comprises, providing said high magnesium serpentine ore in particulate form containing by weight over about 5% magnesium, roasting said ore under oxidizing conditions at a temperature below that temperature at which forsterite recrystallizes, and then adding an amount of said roasted ore to said pregnant liquor sufficient to raise the pH to a level above 2 to reject acid-consuming constitutents present therein.

Another embodiment of the invention resides in providing a limonite nickel ore containing by weight at least about 0.8% nickel and up to about 5% magnesium, providing a high-magnesium serpentine ore containing over about 5% magnesium by weight and subjecting the high-magnesium serpentine silicate ore to an oxidizing roast at a temperature below that temperature at which crystallized forsterite (magnesium silicate) forms.

The limonite nickel ore is then subjected to high pressure leaching in a high pressure circuit in a sulfuric acid solution at an elevated temperature exceeding 150° C and a pressure exceeding 150 psig for a time sufficient to leach substantially the nickel therefrom and form a pregnant nickel-containing liquor and a residue impoverished in said nickel. The pregnant liquor is then separated from the residue and subjected to neutralization at substantially atmospheric pressure and a temperature not exceeding about 100° C by adding thereto an amount of said roasted serpentine ore sufficient to raise the pH to a level at which acid-consuming constituents selected from the group consisting of iron and aluminum are rejected from solution and provide a recyclable residue. Following the foregoing treatment, the pregnant liquor is separated from said residue for the recovery of nickel therefrom and the residue recycled to said high pressure leach circuit for combined leaching with fresh limonite ore fed to said high pressure circuit.

Other embodiments of the invention will be clearly apparent from the following detailed disclosure.

DETAILS OF THE INVENTION

It has been observed that, when serpentinic ore material present in lateritic ore deposits is roasted under oxidizing conditions, e.g. in air, combustion exhaust gases, and the like, at 300° to 820° C (preferably at 500° to 750° C), the dissolution rate of the contained acid-consuming compounds (magnesium compounds) by acid solutions, such as sulfuric acid-containing pressure leach liquor, is significantly increased. The advantage of applying this roasting technique to process lateritic ore deposits are as follows:

- The acid pressure leaching technique can process both limonitic and serpentinic ores simultaneously and economically.
- A high quality nickel-cobalt solution can be generated for subsequent recovery.
- The waste low-nickel serpentine and the bed rock of a laterite ore deposit can be converted into an effective neutralizer.

In determining the optimum roasting temperature, two serpentine samples were examined using differential thermal analysis (DTA) and thermal gravimetric analysis (TGA) over the range of 200° to 1000° C. The chemical and thermal analyses of the high-nickel and low-nickel, high-magnesium serpentine samples are shown in Table 1 below:

Table 1

| Ore No. | Ore Source | Analyses, % Ni | Fe | Al | Mg | TGA Weight Loss, % at 500° C | at 700° C |
|---|---|---|---|---|---|---|---|
| 1. | Drill Core 162097 | 1.94 | 7.1 | 0.80 | 15.0 | 3.4 | 8.5 |
| 2. | Peridotite | 0.40 | 6.0 | 0.20 | 25.0 | 1.0 | 4.7 |

DTA results showed an endothermic reaction at 600° to 700° C which corresponds to the decomposition of serpentine to an amorphous forsterite. An exothermic reaction was noted at about 820° C which corresponds to the recrystallization of the forsterite, which, when recrystallized, is very inert in a dilute acid medium. For maximizing magnesium solubility, therefore, roasting of serpentine should be conducted below 820° C.

The TGA results in Table 1 show a cumulative weight loss in the two examples at 500° C which is mainly contributed by the dehydration of absorbed water. Additional weight loss at 700° C is due mainly to the decomposition of serpentine. Generally speaking, the difference of weight loss between these two temperatures represents the amount of serpentine in the sample.

In determining the neutralization kinetics of the ore and calcined samples, they were leached in 10 gpl sulfuric acid solution at 7 percent solids and 85° C. The results are shown in Table 2.

Table 2

| Ore No. | Roast Temp. ° C | Neutralization Kinetics, Solution, pH | | |
|---|---|---|---|---|
| | | 1 hr. | 2 hr. | 3 hr. |
| | — | 1.7 | 1.8 | 2.0 |
| 1. | 500 | 5.5 | 5.7 | 5.9 |
| | 700 | 7.2 | 7.5 | 7.7 |
| 2. | — | 4.3 | 4.0 | 3.8 |
| | 500 | 3.9 | 4.9 | 5.4 |
| | 700 | 7.3 | 7.6 | 7.6 |

The neutralization rate of sample No. 1 (i.e. high-nickel serpentine) was enhanced substantially by roasting the sample at 500° to 700° C. The neutralization rate of sample No. 2 (i.e. low-nickel serpentine) was also enhanced substantially by roasting the sample at 700° C.

An example of one embodiment of the invention is illustrated in the flow sheet of FIG. 1 which combines acid kill leach with an acid pressure leach using roasted high-magnesium, high-nickel serpentine ore as the neutralizer.

Thus, limonite ore containing 1.7% Ni, 1.6% Mg, 0.15% Co, 41% Fe, 2.5% Al, 0.8% Mn, 2% Cr, 12.1% $SiO_2$ and 11% LOI (Loss on Ignition), the elemental metals being combined with oxygen, is high pressure leached at 10° at 250° C and a pressure of 600 psig in a sulfuric acid solution at a pulp density of 30% and at an acid to ore ratio of about 0.25:1 for about 90 minutes to provide a pregnant nickel solution at a pH of about 0.7. The leached pulp is passed to countercurrent decantation 11 (CCD), the solids going to discharge at 12 and the overflow intermediate pregnant liquor 13 going to acid kill leach circuit at 14 to which roasted (700° C roast) high-Mg, high-Ni serpentine ore is fed. The acid kill leach is carried out at 85° C, the amount of ore at a pulp density of about 20% being sufficient to raise the pH of the pregnant liquor to over 2, for example, over about 2 to less than about 5.5.

The acid killed pulp is sent to solid/liquid separation 15, the final pregnant solution being removed as overflow and sent to metal recovery 16, the acid kill residue being recycled via line 17 to high pressure leach circuit 10 for mixing with fresh limonite ore for the recovery of nickel therefrom.

The advantages of the foregoing flowsheet are (1) Acid Savings: During the acid kill stage, most of the acid-soluble magnesium content of the roasted high-nickel serpentine is dissolved. Therefore, less acid will be consumed during the acid pressure leach of the recycled residue from unroasted serpentine. For example, under the test conditions described in Table 2, 20 and 8 percent of the magnesium in the roasted and the raw high-nickel serpentine, respectively, dissolved within 15 minutes. After 2 hours of leaching, only 15 percent of the magnesium dissolved from the raw ore.

(2) Savings in Operation Time: Acid kill with raw high-nickel serpentine requires unnecessarily long retention time, compared to acid kill with roasted serpentine.

(3) High Quality Ni-Co Solution: The invention provides a high quality nickel-cobalt solution for recovery. As shown in Table 2, the raw high-nickel serpentine can only neutralize the acid solution to pH 2 after 3 hours. Usually, the dissolved ferric iron and aluminum will not be rejected from the solution at ambient temperature until the solution pH reaches over 2, e.g. 2.5 and 4, respectively.

(4) Nickel Recovery From Several Type Ores: The invention provides a method of recovering nickel from both the limonitic and serpentinic nickel-bearing ore fractions by the same process. Experimental work has shown that the residue from acid kill leaching with roasted high-nickel serpentine can be pressure leached with about the same acid addition as for limonitic ore resulting in a combined nickel recovery from the acid kill and pressure leaches of greater than 95 percent. Thus, the residue can be readily mixed in with the limonite autoclave feed slurry.

Figure 2:
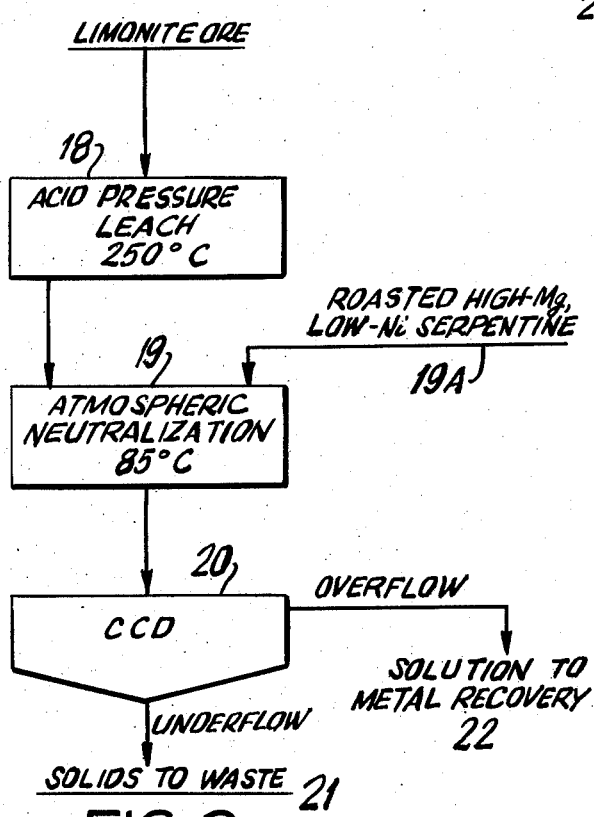
Figure 3:
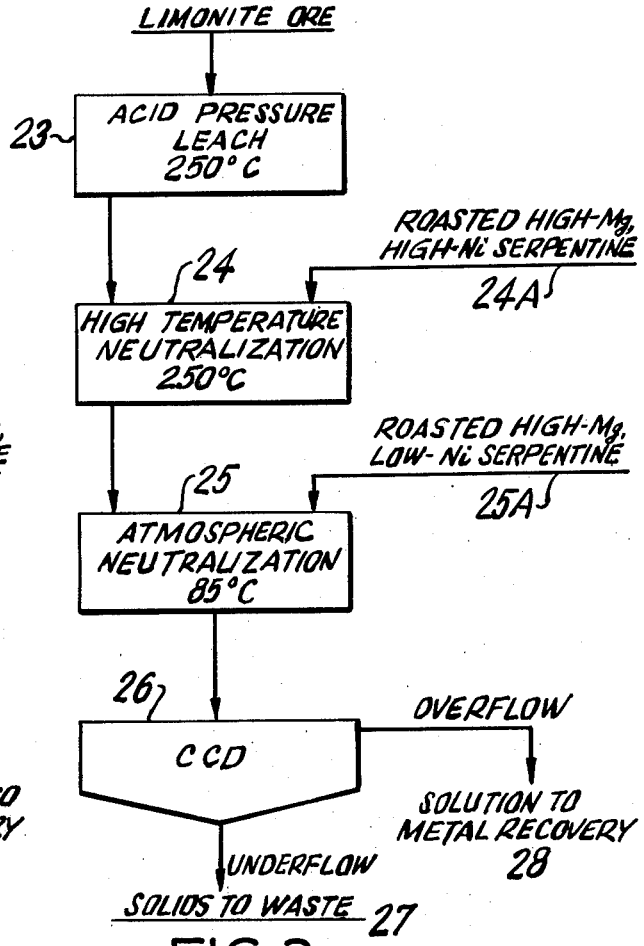
Figure 4:
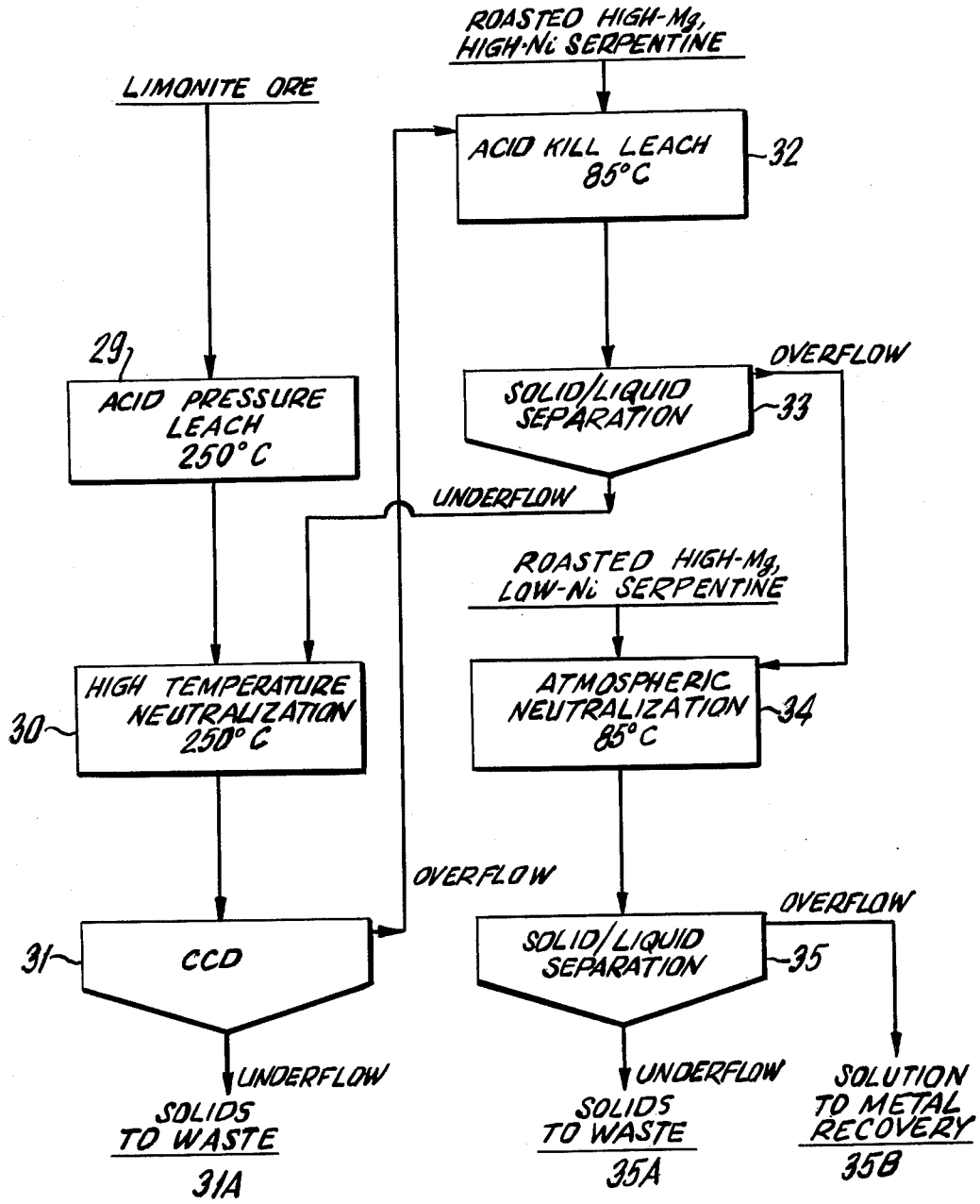

Other flow sheets are shown in FIGS. 2 to 4.

In FIG. 2, limonite ore is fed to acid pressure leach autoclave 18 to form a pulp in a sulfuric acid solution having a pulp denisty of about 30%, the acid to ore ratio being about 0.25:1. After 90 minutes of leaching at 250° C and a pressure of 600 psig, the contents of the autoclave at a pH below 1, i.e. 0.6, is passed to atmospheric neutralization at 19 to which roasted high-Mg, low-Ni, serpentine ore 19A (roasted at 700° C) is fed, the amount of roasted serpentine ore added corresponding on a weight ratio to the limonite ore of about 0.2:1. The atmospheric leach is carried out for about 120 minutes during which the pH rises to over 2, i.e. to 3.5. Generally, the pH ranges from over about 2 to less than about 5.5. Following atmospheric leach, the contents are passed to countercurrent decantation (CCD) 20 to provide an underflow of residue which is discharged at 21, the pregnant solution, containing about 9 gpl Ni, going to overflow for metal recovery at 22.

The flow sheet of FIG. 3 illustrates a process combination in which high temperature neutralization is employed with atmospheric neutralization in which roasted high-Mg, high-Ni serpentine and roasted high-Mg, low-Ni serpentine are employed as the neutralizers.

Thus, limonite ore is high pressure leached in an autoclave at 23 at a pulp density of about 30% in a sulfuric acid solution having a concentration corresponding to an acid to ore ratio on the dry basis of about 0.3:1, the temperature of leaching being 250° C at a pressure of about 600 psig for about 60 minutes.

The pH of the pregnant liquor leaving the autoclave is less than 1, e.g. 0.7, the liquor and the solids going to high temperature neutralization in an autoclave at 24 where roasted high-Mg, high-Ni serpentine ore 24A is added at a weight ratio on the dry basis of serpentine ore to the solids of the leached limonite ore of about 0.1 to 1. The high temperature neutralization is carried out for a time sufficient to effect neutralization of the mix at a pH not exceeding about 1.5, for example, 1.2 or less. Thereafter, the mix is transferred to atmospheric neutralization 25 where roasted high Mg, low-Ni serpentine ore 25A is added, the neutralization temperature ranging up to about 100° C, e.g. 85° C. The amount of ore 25A added is sufficient to raise the pH to over 2 but less than 5.5, the preferred pH being in the neighborhood of about 3.5.

Following the second neutralization step, the mix is passed to countercurrent decantation (CCD) 26 to provide an underflow of solids going to discharge 27 and an overflow of pregnant liquor going to metal recovery 28.

The embodiment of FIG. 4 utilizes a recycling of solids during leaching to effect overall recovery of nickel from both the limonite ore and the roasted high-Mg, high-Ni serpentine and some nickel recovery from roasted low-Ni serpentine.

Referring to FIG. 4, high-Ni, low-Mg limonite ore is formed into a pulp with a sulfuric acid solution and high pressure leached at 29 at a temperature of about 250° C and a pulp density of about 30% at an acid to ore weight ratio of about 0.25:1 and a pressure of about 600 psig for about 60 minutes.

The total contents of the high pressure leach at a pH of less than 1, e.g. 0.7, are passed to high temperature neutralization (250° C) at 30 to which underflow solids from the acid kill leach step 32 are fed. Following high temperature neutralization at 600 psig for 30 minutes, the pH rises to less than 1.5, e.g. 1.2, the amount of acid killed solids (roasted high-Mg, high-Ni serpentine) being sufficient to raise the pH to the desired level.

All of the high temperature neutralized material is passed to countercurrent decantation (CCD) 31 with the underflow solids 31A going to discharge and the pregnant liquor overflow (intermediate pregnant liquor) going to the acid kill leach circuit 32 to form a pulp of roasted high-Mg, high-Ni serpentine silicate ore fed thereto of about 20%, pulp density, the neutralization step being carried out at a temperature not exceeding about 100° C (e.g. 85° C) for about 90 minutes, the pH rising to over about 2 and less than about 3.5.

The total contents of the acid kill leach are fed to the solid/liquid separation step 33, with the underflow solids being recycled to high temperature neutralization 30 as stated hereinbefore. The overflow intermediate pregnant liquor is passed to atmospheric neutralization step 34 and a pulp formed with roasted high-Mg, low-Ni serpentine silicate ore thereto to provide a pulp density of about 10%, the temperature of neutralization not exceeding about 100° C, e.g. 85° C. The neutralization is carried out for a time sufficient (e.g. 120 minutes) to cause the pH to rise to at least about 4 but less than about 5.5.

The treated final pregnant liquid and solids are passed to solid/liquid separation 35 with the final pregnant liquor removed as overflow and sent to metal recovery 35B and the solids underflow discharged at 35A.

As will be clearly apparent, various combinations of steps may be employed in combining the leaching of high-Ni, low-Mg limonite ore with the improved neutralization capability of roasted high-Mg serpentine ore containing either high or low nickel.

In the recovery of nickel from laterite ores, it is common practice in processing laterite ore to scalp off and discard the coarse fraction of the ore because of its low nickel content. Generally, the cutoff point is in the range of +3 to +100 mesh. It has been found that, in the specific case of a deposit referred to as the Prony laterite deposit, the coarse waste rock can contain as much as 25% magnesium. Some of this coarse waste rock (0.4% Ni, 25% Mg) was used in a series of tests where the rock was ground to 100% minus 10 mesh and a sample of material was roasted in air at 700° C for 1 hour. The roasted and unroasted material were then used to neutralize the leached pulp from sulfuric acid pressure leaching of low-magnesium, limonitic Prony ore (1.8% Ni, 43% Fe, 2.1% Al, 1.5% Mg). The pressure leach was conducted in a 2 liter titanium autoclave for one hour at 250° C and 33% solids with 0.24 parts by weight of sulfuric acid for each part of ore. The neutralization was performed in a 0.5 liter glass reactor maintained at 85° C to simulate average conditions in the flash tank, surge tank and first part of the CCD circuit. Note FIG. 2 for the process used. Results are shown in the following table for tests with no neutralizer, unroasted waste rock neutralizer and roasted waste rock neutralizer.

Table 3

| Neutralizer Pretreatment | Neutralizer Feed Ore Ratio | Neutralization Time Hours | Solution Grams/Liter Ni | Fe | Al | pH |
|---|---|---|---|---|---|---|
| | | 0 | 9.0 | 1.7 | 3.2 | 0.6 |
| | | 1 | 9.0 | 1.9 | 3.2 | 0.6 |
| *None (1) | None | 3 | 9.0 | 2.2 | 3.3 | 0.6 |
| | | ½ | 9.0 | 2.5 | 3.4 | 1.0 |
| | | 1 | 9.0 | 2.2 | 3.3 | 1.2 |
| Unroasted (2) | 0.10 | 3 | 9.1 | 1.1 | 3.4 | 1.4 |
| | | ½ | 9.0 | 2.4 | 3.5 | 1.3 |
| | | 1 | 9.0 | 1.4 | 3.1 | 1.5 |
| Unroasted (3) | 0.20 | 3 | 9.1 | 0.9 | 2.7 | 2.3 |
| | | ½ | 9.0 | 1.3 | 3.2 | 1.3 |
| | | 1 | 9.0 | 0.8 | 2.4 | 1.4 |
| Roasted (4) | 0.10 | 3 | 9.1 | 0.4 | 2.5 | 1.9 |
| | | ½ | 9.0 | 0.2 | 2.1 | 2.4 |
| | | 1 | 9.0 | 0.2 | 2.3 | 3.0 |
| Roasted (5) | 0.20 | 3 | 9.1 | 0.2 | 1.6 | 3.7 |

*This test was performed at 60° C.

Referring to the table, it will be noted that roasted high-Mg serpentine ore has a greater effect as a neutralizer as compared to the unroasted ore. This is evident from the substantial decrease in iron using the roasted ore as shown in tests (4) and (5) as compared to the use of raw serpentine or no serpentine in tests (1) to (3).

In test (5), it will be noted that, with a weight ratio of neutralizer to ore of about 0.2 to 1, the iron was immediately rejected to 0.2 gpl within one-half hour and the pH raised to 2.4. In the test where unroasted ore was used at the same ratio [note test (3)], it took 3 hours to lower the iron to only 0.9 gpl and to raise the pH to 2.3. The aluminum content of the pregnant liquor is more consistently reduced with roasted serpentine ore.

The foregoing results demonstrate the need for rapid neutralization of the pressure leached pulp if redissolution of iron and aluminum is to be avoided. They also show the superior neutralizing ability of the roasted waste rock. The coarse serpentine rock need not be discarded, but can be crushed and ground to the optimum size, roasted, and used to neutralize the pressure leached pulp, possibly in the flash tank, and any other acidic solution that requires neutralization. It is economically advantageous to use this material, which is a natural by-product of normal laterite processing rather than to produce or purchase another neutralizer such as coral mud, lime, or magnesia which may not be available at the site at which the process is being conducted.

The foregoing process is applicable to the leaching of limonite ore containing by weight about 0.8 to 2.5% Ni (e.g. 1.25 to 2.5% Ni), about 0.005 to 1% Co, about 0.25 to 5% Mn, about 0.3 to 15% Cr, about 0.2 to 10% Al, up to about 5% Mg (e.g. less than about 3%), about 2 to 45% $SiO_2$ and about 10 to 55% iron making up substantially the balance, the foregoing metal values being present as oxides.

The high-Mg, high-Ni serpentine ore used for neutralization may range in composition by weight from about 0.8 to 5% Ni (e.g. 1.5 to 5%), about 0.005 to 1% Co, about 0.25 to 5% Mn, about 0.3 to 15% Cr, about 0.2 to 10% Al, over 5 to 30% Mg (e.g. 8 to 30% Mg), about 2 to 45% $SiO_2$ and about 10 to 55% Fe, the foregoing metal vales being present as oxides.

The high-Mg, low-Ni serpentine ore will generally have a composition about the same as the high-Mg, high-Ni serpentine ore hereinabove, except that the nickel content is less than 1% and generally less than about 0.5% by weight.

In high pressure leaching the limonite ore, the sulfuric acid to ore ratio by weight may range from about 0.1 to 1 to 0.4 to 1, the pulp density from about 20 to 45% based on the total weight of the ore and acid solution, the temperature from about 150° to 300° C and the pressure from about 225 psig to 1750 psig, the pH of the pregnant liquor following leaching being less than about 1, and generally less than about 0.7.

When the pregnant liquor is neutralized with roasted high-Mg serpentine ore in the acid kill leach or subjected to atmospheric neutralization at temperatures up to 100° C (e.g. 50° to 90° C), the pH is raised to over 2 and less than 5.5 before the final pregnant liquor is sent to metal recovery.

Where the pulp and pregnant solution following high temperature and high pressure leaching is high temperature neutralized at 150° to 300° C, e.g. 250° C, and at a pressure of about 225 to 1750 psig, e.g. 600 psig, the amount of roasted high-Mg serpentine employed is sufficient to raise the pH to a value not exceeding 1.5, e.g. 1.20

As stated herein, the roasting temperature of the high-Mg serpentine should not exceed 820° C and preferably not exceed about 750° C. The roasting for the purposes of the invention is carried out under oxidizing conditions at over 300° less than 820° C, provided the temperature is below that temperature at which forsterite recrystallizes. Preferably, the roasting temperature ranges from about 500° to 750° C.

The ratio of serpentine ore to limonite ore in the high temperature neutralization circuit may range by weight from about 0.1 to 1 to 0.5 to 1, a preferred ratio being 0.15 to 1 to 0.25 to 1 in order to assure optimum rejection of iron and aluminum and good nickel recovery. However, the ratio will generally depend on the difference in magnesium content between the low-magnesium limonite ore and the higher-magnesium serpentine ore, the ratio being smaller, the larger the difference. For example, the greater the difference between the two ores in magnesium content, the less is the amount of the roasted high-magnesium ore required as a neutralizing agent. Assuming the low magnesium limonite ore contains 1% soluble Mg and the roasted high-magnesium ore contains about 14% soluble Mg, the predetermined ratio of the high magnesium ore added as a neutralizer to the low magnesium ore would preferably be about 1:6 or approximately 0.165 to 1. Where the high magnesium ore contains about 5% soluble Mg, the predetermined ratio would be about 1:2 or 0.5:1.

Putting it another way, for a low magnesium ore containing less than 5 or 3% Mg and a roasted high-magnesium ore containing over about 5% and ranging to 30% magnesium, the ratio of the roasted high-magnesium ore to the low magnesium ore for neutralization will generally vary substantially inversely to the difference in magnesium content of the two types of ore and may range from about a ratio of 0.5 to 1 at the lower range of the difference (approximately a difference of 5) to as low as 0.1 to 1 at the higher range of the magnesium difference, for example, a difference of approximately 15.

The greater the difference in the soluble magnesium content between the feed ore (low magnesium ore) and the roasted neutralizing ore (high magnesium ore), the more efficient and economical the process. As stated previously, the use of roasted ore is advantageous in that it speeds up the time of neutralization which is important economically, as compared to slower times obtained with raw serpentine ore.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. In a method of leaching a low-magnesium nickel-containing oxide ore, wherein an oxide ore containing by weight at least about 0.8% nickel and magnesium ranging up to about 5% is leached in a sulfuric acid solution at an elevated temperature exceeding about 150° C and an elevated pressure exceeding about 150 psig for a time sufficient to leach substantially the nickel therefrom and form a pregnant liquor thereof of pH less than about 1 and a leached residue, and wherein said pregnant liquor is neutralized by adding thereto a raw high-magnesium nickel-containing serpentine silicate ore containing at least about 0.8% nickel and over 5% magnesium while at the same time leaching nickel from said serpentine ore, the improvement of enhancing the neutralization capability of said raw high-magnesium ore which comprises, subjecting said raw high-magnesium serpentine ore to an oxidizing roast prior to said neutralization step at a temperature below the temperature at which forsterite recrystallizes, said roasting temperature being below 820° C, subjecting said pregnant liquor to neutralization at atmospheric pressure and a temperature not exceeding about 100° C by adding thereto an amount of said roasted ore to raise the pH to above 2 while leaching nickel from said high-magnesium ore and provide a residue thereof, the rate of neutralization with roasted ore being faster than the rate using unroasted ore, separating said neutralized pregnant liquor from said high-magnesium residue for the recovery of nickel therefrom, recycling said high-magnesium residue back into the leaching process for mixing with fresh low-magnesium ore for leaching at said elevated temperature and pressure, leaching said fresh low-magnesium ore together with said high-magnesium residue at said temperature exceeding about 150° C and said pressure exceeding about 150 psig to form leached solids thereof and said pregnant liquor of pH less than about 1 which is thereafter neutralized with said roasted high-magnesium ore, and disposing of said leached solids.

2. The method of claim 1, wherein said high-magnesium serpentine ore contains about 8 to 30% by weight of magnesium.

3. The method of claim 2, wherein said roasting temperature ranges from about 500° to 750° C.

4. The method of claim 1, wherein the starting pH of said nickel-containing pregnant leach liquor is less than about 0.7.

5. The method of claim 1, wherein said low-magnesium ore contains by weight about 0.8 to 2.5% nickel, and wherein said high-magnesium ore contains about 8 to 30% magnesium and about 0.8 to 5% nickel.

6. The method of claim 1, wherein said neutralization is carried out at substantially atmospheric pressure and a temperature not exceeding about 100° C.

7. In a method of leaching a low-magnesium limonite nickel ore, wherein said low magnesium limonite ore containing by weight at least about 0.8% nickel and up to about 5% magnesium is leached in a sulfuric acid solution at an elevated temperature exceeding 150° C and an elevated pressure exceeding about 150 psig for a time sufficient to leach substantially the nickel therefrom and form a pregnant liquor thereof of pH less than about 1 and a leached residue, and wherein said pregnant liquor is neutralized by adding thereto a raw high-magnesium nickel-containing serpentine silicate ore while at the same time leaching nickel from said ore, the improvement of enhancing the neutralization capability of said raw high-magnesium ore which comprises, subjecting a first raw high-magnesium high-nickel serpentine silicate ore containing over about 5% magnesium and over about 0.8% nickel by weight to an oxidizing roast at a temperature below the temperature at which recrystallized forsterite forms, said temperature being less than about 820° C, subjecting a second raw high-magnesium, low-nickel serpentine silicate ore containing over about 5% magnesium and less than about 1% nickel by weight to an oxidizing roast at a temperature below the temperature at which recrystallized forsterite forms, said temperature being less than about 820° C, subjecting said leached limonite residue and the pregnant liquor thereof to high temperature neutralization at a temperature exceeding 150° C and a pressure exceeding 150 psig by mixing therewith said roasted first high-magnesium, high-nickel serpentine ore, the amount of serpentine ore added being sufficient to raise the pH of the pregnant solution to a value not exceeding about 1.5, passing said high temperature neutralized mix to an atmospheric neutralization step to which said roasted second high-magnesium low-nickel serpentine ore is added, the temperature of neutralization not exceeding about 100° C, the amount of ore added being sufficient to raise the pH to over 2, maintaining said mix at said atmospheric neutralization temperature until said pH reaches over 2 and provide a nickel impoverished residue, and separating the pregnant liquor from said residue and passing it to nickel recovery.

8. The method of claim 7, wherein the first and second serpentine ores contain about 8 to 30% magnesium, and wherein said roasting temperature ranges from about 500° to 750° C.

9. The method of claim 7, wherein said limonite ore is high pressure leached to provide a pregnant liquor prior to neutralization having a pH less than about 0.7.

10. In a method of leaching a low-magnesium limonite nickel ore, wherein said low-magnesium limonite ore containing by weight at least about 0.8% nickel and up to about 5% magnesium is leached in a sulfuric acid solution at an elevated temperature exceeding 150° C and an elevated pressure exceeding about 150 psig for a time sufficient to leach substantially the nickel therefrom and form a pregnant liquor thereof of pH less than about 1 and a leached residue, and wherein said pregnant liquor is neutralized by adding thereto a raw high-magnesium nickel-containing serpentine silicate ore while at the same time leaching nickel from said ore, the improvement of enhancing the neutralization capability of said high-magnesium ore which comprises, subjecting a first raw high-magnesium, high-nickel serpentine silicate ore containing over about 5% magnesium and over about 0.8% nickel by weight, to an oxidizing roast at a temperature below the temperature at which recrystallized forsterite forms, said temperature being less than about 820° C, subjecting a second raw high-magnesium, low-nickel serpentine silicate ore containing over about 5% magnesium and less than about 1% nickel by weight to an oxidizing roast at a temperature below the temperature at which recrystallized forsterite forms, said temperature being less than about 820° C, subjecting said leached limonite residue and the pregnant liquor thereof to high temperature neutralization at a temperature exceeding 150° C and a pressure exceeding 150 psig by mixing therewith a previously leached thickened pulp of said roasted high-magnesium, high-nickel serpentine ore, the amount of thickened pulp added being sufficient to raise the pH of the pregnant solution to a value not exceeding about 1.5, subjecting said high temperature neutralized mix to solid/liquid separation, with the solids going to discharge and the intermediate pregnant solution going to an acid kill leach circuit, preparing a pulp of said roasted high-magnesium, high-nickel serpentine ore with said intermediate pregnant liquor and subjecting said pulp to said acid kill leach at a temperature not exceeding about 100° C for a time sufficient to raise the pH to a value over 2, subjecting said acid-killed leached pulp to solid/liquid separation to produce an underflow of thickened leached pulp which is fed to said high temperature neutralization step and produce an overflow of said intermediate pregnant liquor, forming a pulp of said roasted second high-magnesium, low-nickel serpentine ore with said intermediate pregnant liquor and subjecting said pulp to atmospheric neutralization at a temperature not exceeding about 100° C for a time sufficient to raise the pH to over about 3.5, and then subjecting the neutralized pulp-pregnant liquor mixture to solid/liquid separation to provide an overflow of a final pregnant solution at over said pH 3.5 which is sent to metal recovery and a leached residue which goes to discharge.

11. The method of claim 10, wherein said first and second serpentine ores contain about 8 to 30% magnesium and are roasted at a temperature from about 500° to 750° C.

12. The method of claim 10, wherein said pressure leached limonite ore provides a pregnant liquor prior to neutralization having a pH less than about 0.7.

* * * * *